US005675923A

United States Patent [19]

Sarkisian et al.

[11] Patent Number: 5,675,923

[45] Date of Patent: Oct. 14, 1997

[54] RIGID SIGN WITH PROTECTIVE CHANGEABLE INDICIA MEMBER

[75] Inventors: John Sarkisian, Farmington Hills; David U. Hillstrom, Novi, both of Mich.

[73] Assignee: Marketing Displays, Inc., Farmington Hills, Mich.

[21] Appl. No.: 526,411

[22] Filed: Sep. 11, 1995

[51] Int. Cl.[6] ..... G09F 15/00

[52] U.S. Cl. ..... 40/612; 40/611

[58] Field of Search ..... 40/606, 607, 611, 40/612, 615, 618, 620, 790, 791, 792, 793

[56] References Cited

U.S. PATENT DOCUMENTS

| | | | |
|---|---|---|---|
| 614,953 | 11/1898 | Hotchkiss | 40/612 X |
| 3,310,901 | 3/1967 | Sarkisian . | |
| 4,145,828 | 3/1979 | Hillstrom . | |
| 4,245,922 | 1/1981 | Auriemma | 40/612 X |
| 4,253,415 | 3/1981 | Ferch | 40/612 X |
| 4,288,053 | 9/1981 | Sarkisian . | |
| 4,337,590 | 7/1982 | Jackson | 40/615 |
| 4,507,887 | 4/1985 | Seely . | |
| 4,548,379 | 10/1985 | Seely et al. . | |

*Primary Examiner*—Kenneth J. Dorner
*Assistant Examiner*—Cassandra Davis
*Attorney, Agent, or Firm*—Brooks & Kushman

[57] ABSTRACT

A rigid sign member with a changeable protective plastic overlay is disclosed. The overlay member can contain a wide variety of various messages and display indicia thus allowing the rigid sign backing member to be used for numerous different situations. Holder members on the rigid sign member hold the overlay member in place. One of the holder members can be removable for removal and placement of the overlay member. Preferably, the front surface of the rigid sign member has a reflective surface and the overlay member is made from a clear or transparent material.

7 Claims, 6 Drawing Sheets

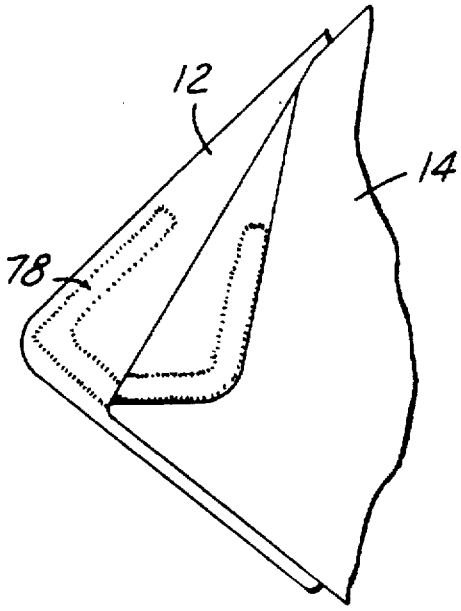
FIG.10
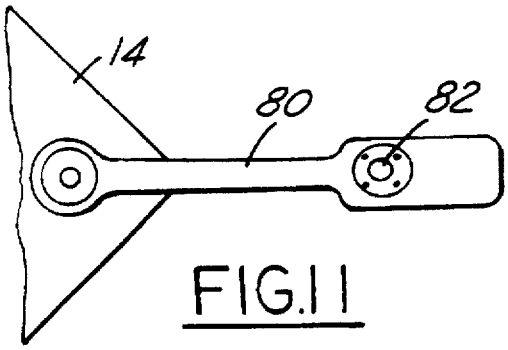
FIG.11
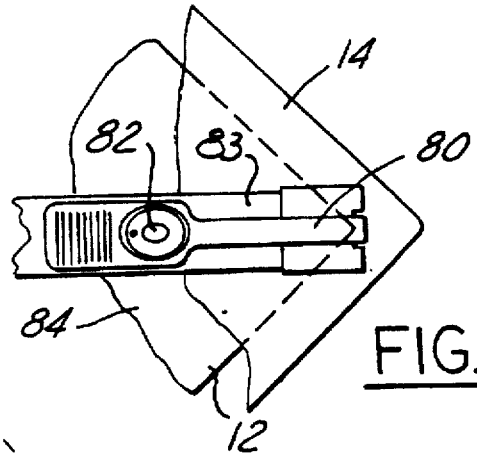
FIG.12
FIG.13
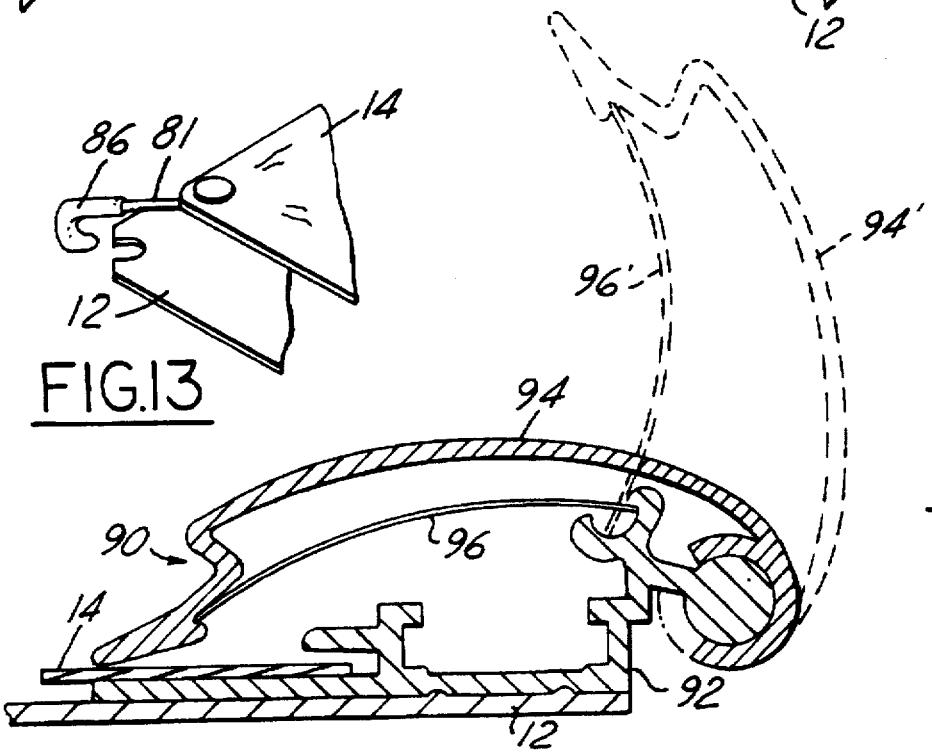
FIG.14

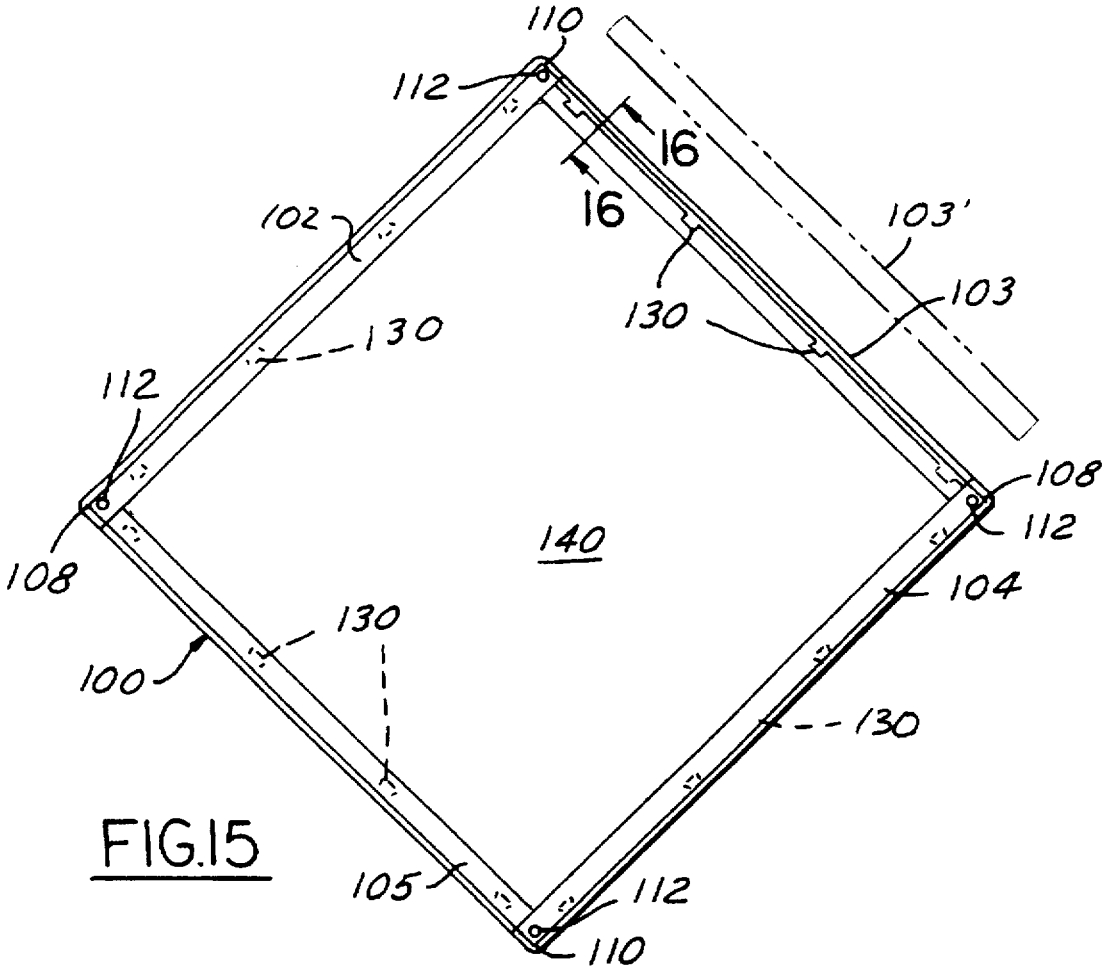
FIG.15
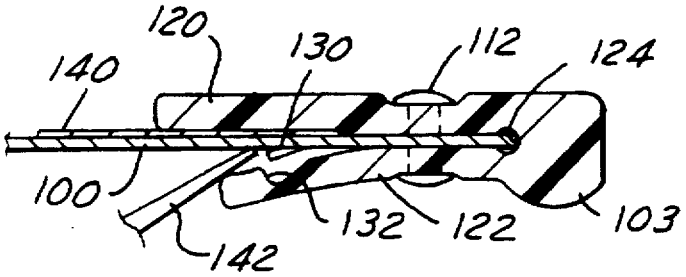
FIG.16B
FIG.16A
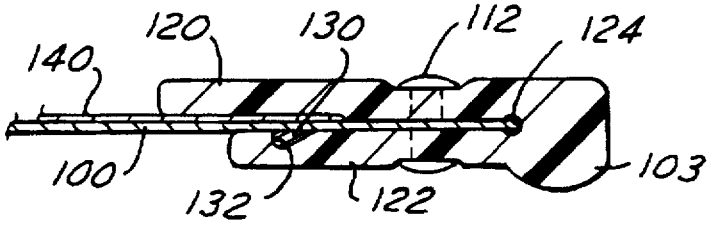

RIGID SIGN WITH PROTECTIVE CHANGEABLE INDICIA MEMBER

TECHNICAL FIELD

The present invention relates to rigid signs for displaying information or warning messages to passing motorists and pedestrians.

Background of the Invention

It is well known for businesses, utility companies, construction companies, state, county and state agencies, and the like to display informational signs to passing motorists and the public, such as signs with informational items or traffic control messages. With some of these businesses, this requires a significant number of different messages and notices due to the substantial number of different situations and events which might occur. For example, at construction and utility sites (also known as work zones), messages such as "Stop", "Slow", "Accident Ahead", "Prepare To Stop", "Merge", "All Traffic", "Road Closed", "Road Work Ahead", etc. are all used on a frequent basis.

The signs are commonly placed on uprights which are connected to stands or bases in order to display the sign. Often, the upright or base has a spring mechanism which allows the sign and upright to deflect during windy conditions.

At the present time, signs are typically of two basic types, flexible and rigid. The flexible signs are made of a soft vinyl material and adapted to be held in a display position by a pair of cross braces. The flexible signs can be disassembled and rolled up for storage and transportation.

The rigid signs are typically made from wood, such as plywood, or metal, such as aluminum. It is also possible to make the signs from plastic materials. Typically, these signs are 3' by 3' or 4' by 4' in size, depending on the desired use or applicable specifications. Wood signs are typically ½" to 1" in thickness, while metal signs are typically 1/16" to ⅛" in thickness. Due to the large number of possible messages that might be needed at a particular site, it is necessary to stock a significant number of signs with different messages, most of which may not be utilized at the site. For this purpose, some construction companies, barricade rental companies, and construction supply companies stock hundreds or even thousands of rigid signs. Some state agencies also stock hundreds or more of rigid signs.

Also, rigid signs are subject to constant handling at construction sites and are subject to considerable abuse and deterioration. The corners of the rigid signs are particularly susceptible to breakage and disfigurement. Also, the reflective faces, which can be very expensive, often become so scratched or marred that they must be replaced, again at considerable expense.

It is an object of the present invention to provide an improved sign for display of messages to the passing public. It is another object of the present invention to provide a rigid sign with interchangeable messages or indicia in order to allow inventory of a fewer number of signs.

It is a further object of the present invention to provide a rigid sign which is more durable and has a longer life than existing rigid signs, and is more cost-effective over time. It is a still further object of the present invention to provide a rigid sign which protects the reflective face from damage. Still another object is to provide a sign with a changeable message or indicia system which allows change of the messages in a quick and easy manner.

A still further object of the present invention is to provide a rigid sign which allows the message to be customized in a more cost-effective manner.

These and other features, objects and benefits of the present invention will become apparent from the following description of the invention, when viewed in accordance with the accompanying drawings and appended claims.

SUMMARY OF THE INVENTION

The present invention provides a rigid sign with a changeable message or indicia. The sign has a backing member which has the desired size (3'×3' or 4'×4') and is made from a rigid material, such as wood or metal. One face of the sign has a reflective material on it if required by applicable regulations.

The message for the rigid sign is placed on a transparent sheet of material (a/k/a "overlay"), particularly clear plastic, which is positioned on the front face of the rigid sign. The rigid sign acts as a backing member.

The overlay is held in place around the edges of the rigid sign by a series of clips or holder members. These edge members can be made of a transparent material so that indicia on the edges of the overlay can be seen through them. Alternately, a border or the like can be imprinted on the edge members.

The message on the overlay is preferably printed or applied in reverse form on the side of the overlay facing the rigid sign. This protects the message from being damaged or altered during use. The overlay member itself acts as a protective layer covering the reflective surface on the sign and protecting it from damage.

Once the rigid sign is in place, the message can be changed as desired. This is accomplished by removing the existing transparent overlay with one message thereon and replacing it with another transparent overlay with a second message thereon. Preferably, one of the edge members is removably attached to the sign and can be removed with an appropriate tool (such as a screw driver) for removal and placement of the overlay.

DESCRIPTION OF THE DRAWINGS

FIGS. 7–14 illustrate other types of devices and mechanisms which can be used to secure the overlay member to a rigid sign in accordance with the present invention;

FIG. 15 illustrates another embodiment of the invention; and

FIGS. 16A–16B are cross-sectional views of the sign shown in FIG. 15 and depict the fastening and removal of edge members on the sign.

BEST MODE(S) FOR CARRYING OUT THE INVENTION

The present invention is shown in various details in FIGS. 1–5 of the drawings and generally designated by the numeral 10.

Figure 1:
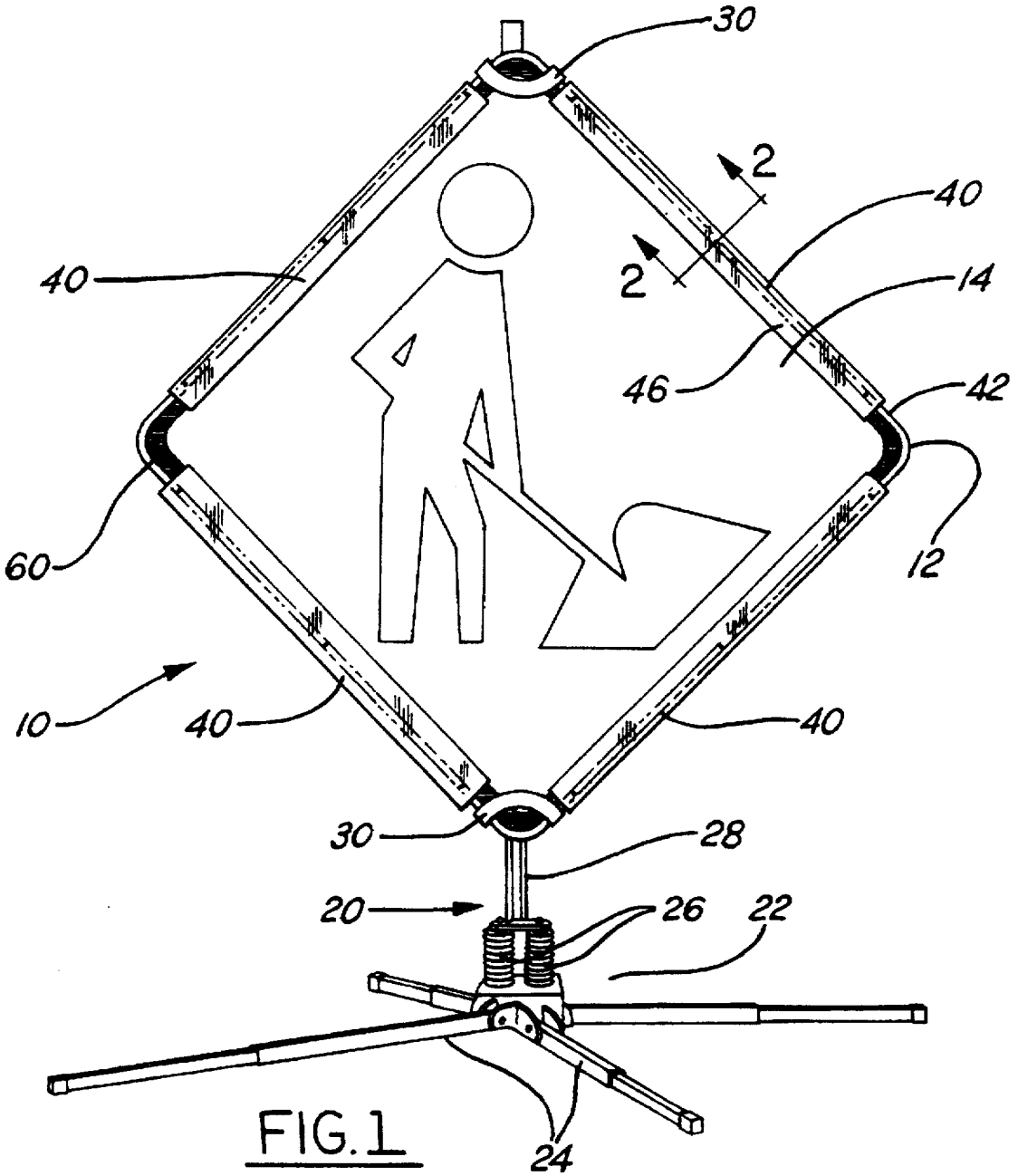
FIG. 1 illustrates a rigid sign in accordance with the present invention.
Figure 3:
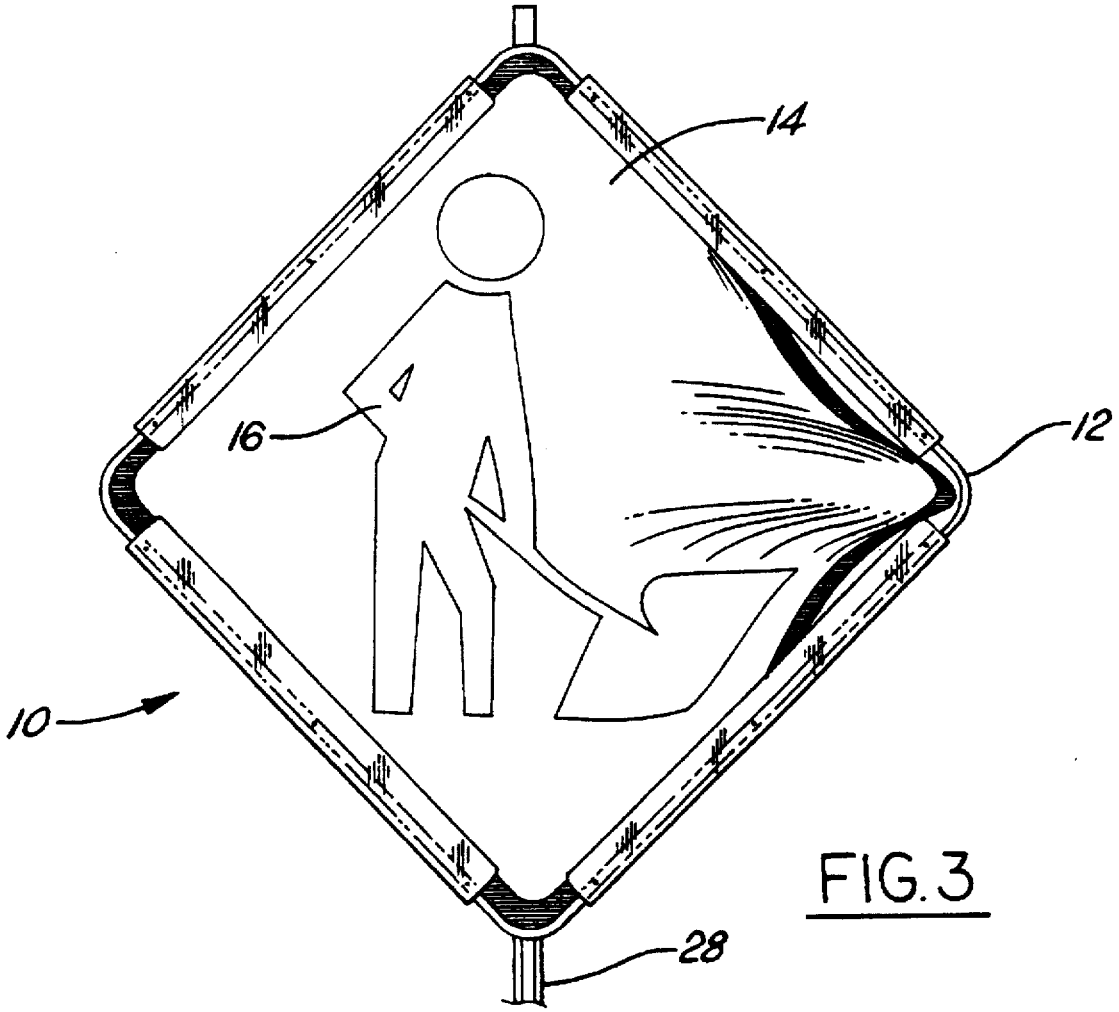
FIG. 3 illustrates a process by which a transparent display overlay can be installed on a rigid sign.
Figure 5:
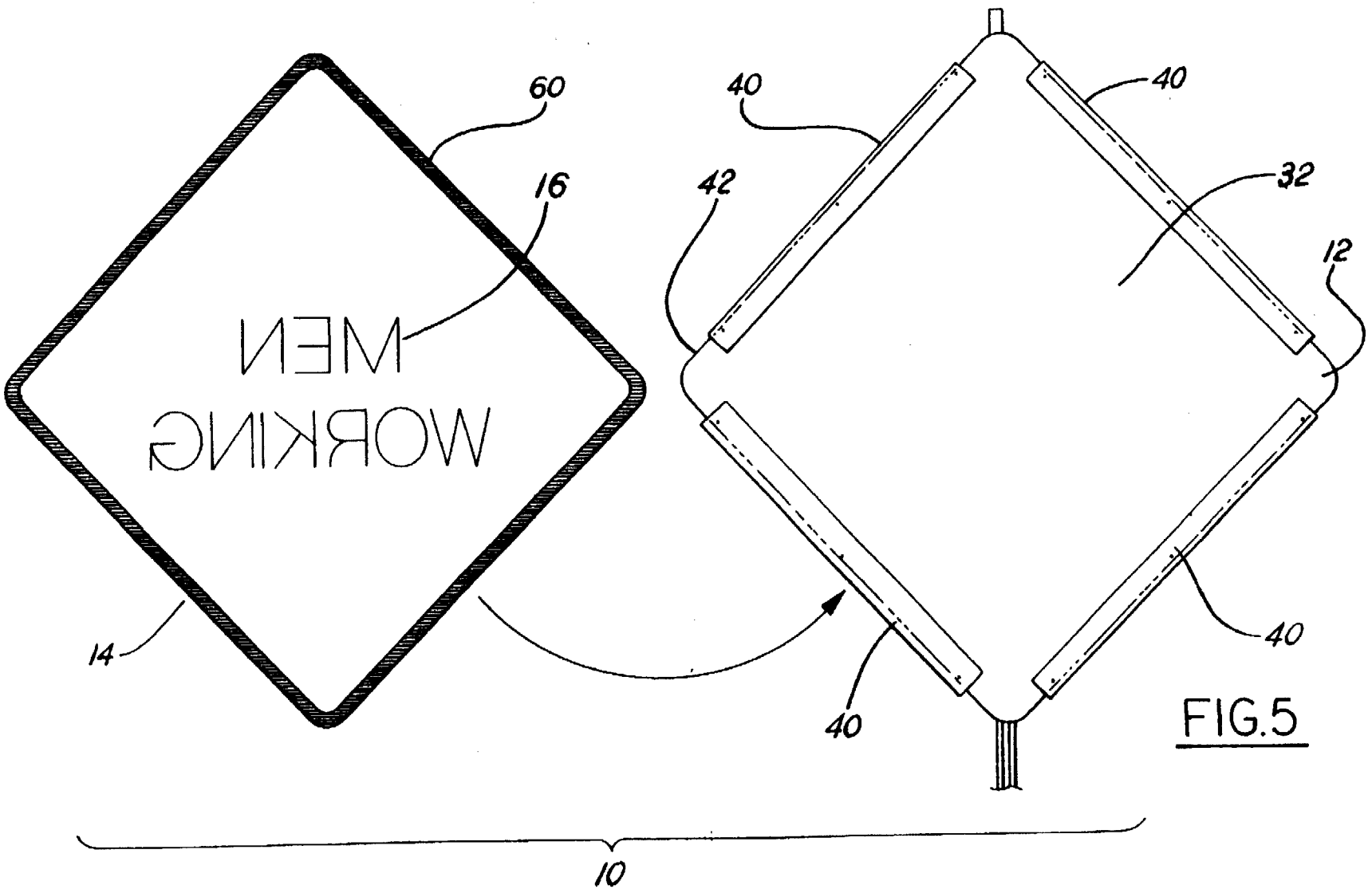
FIG. 5 is an exploded view showing the features of the present invention.

The invention generally comprises a rigid sign member 12, a transparent overlay member 14, and a plurality of edge or holder members 40. The transparent overlay member 14 preferably is a sheet of clear plastic material with a message or display indicia 16 positioned on one side thereof. In FIGS. 1 and 3, the display indicia is an international sign of a person working, while the display indicia shown in FIG. 5 is the phrase "Road Work Ahead".

Figure 6:
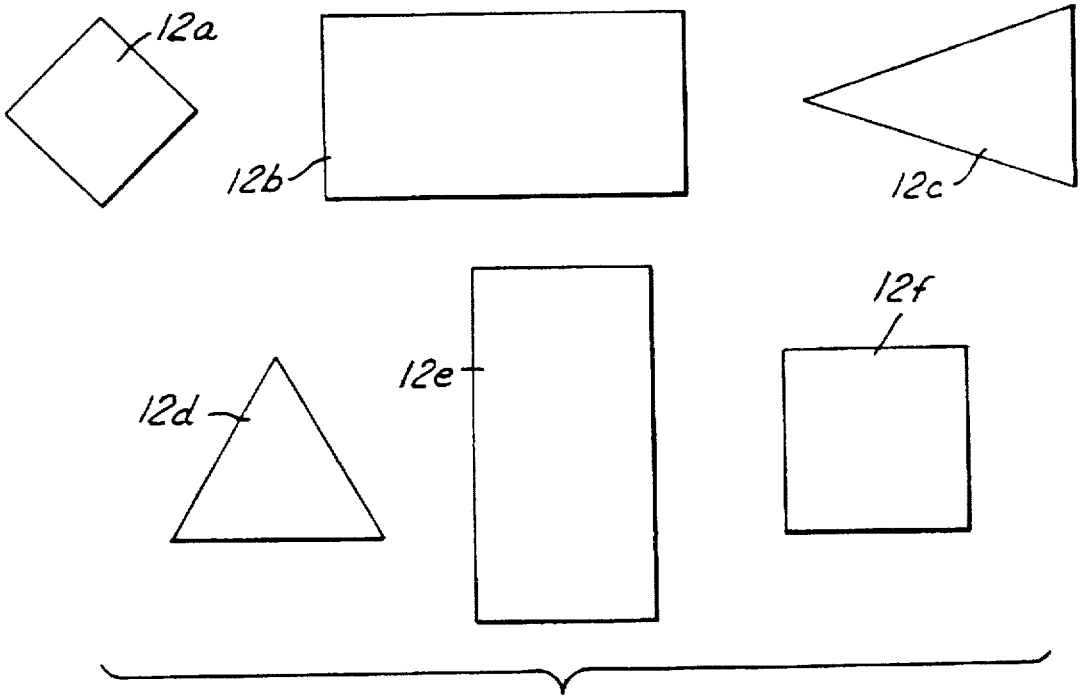
FIG. 6 illustrates some of the various sizes and shapes of signs for use with the present invention.

The rigid sign is preferably 3'×3' or 4'×4' in size, which are the most common sizes of signs utilized in the construction and utility industries. The signs are typically displayed in a diamond-shape configuration as shown, but they also can be positioned in any other conventional manner, such as in a square or rectangular manner, that is with the upper and lower edges parallel to the ground. In the latter event, of course, the message or indicia 16 would be positioned on the overlay member 14 in a different orientation. Also, it is understood that the present invention can be used with any rigid sign, regardless of its size or shape. In this regard, representative signs of various sizes and shapes in which the present invention can be used are shown in FIG. 6. These are designated by the reference numerals 12*a*–12*f*.

The rigid sign is typically held upright by a display stand 20, although the sign could be held by any support such as a pair of T-legs, or be mounted on a wall or other surface. The display stand 20 can be of any type, but preferably has a base 22 with a series of longitudinally extending legs or ground-engaging members 24, a pair of coil springs 26 and an upright 28. Sign stands of this type are shown and described, for example, in U.S. Pat. Nos. 4,507,887 and 4,548,379. The rigid sign 12 is held on the upright 28 by one or more conventional sign brackets 30. One preferred form of sign brackets of this type is shown and disclosed in U.S. Pat. No. 4,288,053.

The front surface 32 of the sign 12 is preferably covered with a reflective material, such as a retroreflective Reflexite material. That material is available from the Reflexite Corporation in New Britain, Connecticut and reflects most incoming light back to the light-source. These materials show up brightly in headlights or daylight at a wide range of observation angles. Reflective materials from 3M Company, such as Engineering Grade, High Intensity, and Diamond Grade, could also be utilized. Suitable reflective materials are also available from several other companies.

Figure 2:
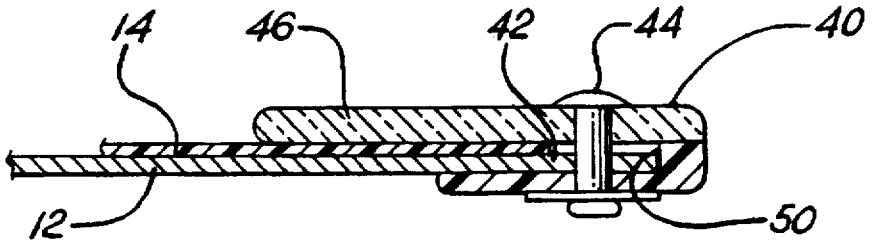
FIG. 2 is a cross section of the edge of the sign, taken along line 2—2 in FIG. 1 and in the direction of the arrows.

A plurality of holder members 40 are positioned on the four elongated outer edges of the rigid sign panel 12. As shown in FIG. 2, the holder member has a generally U-shaped cross section and is positioned around the edge 42 of the sign 12 and held in place by conventional fasteners, such as rivets 44. Preferably, at least the front portion 46 of the holder member 40 is made from a transparent material in order to allow indicia and graphic designs positioned adjacent the outer edges of the overlay member 14 to be visible. In this regard, the front portions preferably are made from a clear plastic material, such as polycarbonate. Other clear, durable plastic materials could be utilized.

For lightness and ease of handling, the rigid signs 12 are preferably formed of aluminum sheet material. Aluminum panels having a thickness on the order of 0.080" have been found to be acceptable for this purpose. Of course, other rigid sign materials could be utilized, such as other metal materials, plastic materials, or wood, including plywood. Aluminum materials, however, are lighter than plywood materials, are more durable, will last longer and will withstand more abuse and mishandling.

As shown in FIGS. 1–5, preferably four holder members 40 are provided, one along each of the four edges of the rigid sign. It is possible, of course, to provide a fewer number of holder members, or a larger number of shorter holder members along each of the edges of the sign 12. Further, it is possible to provide a message sign with more or less than four edges. All of these alternatives are fully in accordance with the purposes and objects of the present invention.

Figure 4:
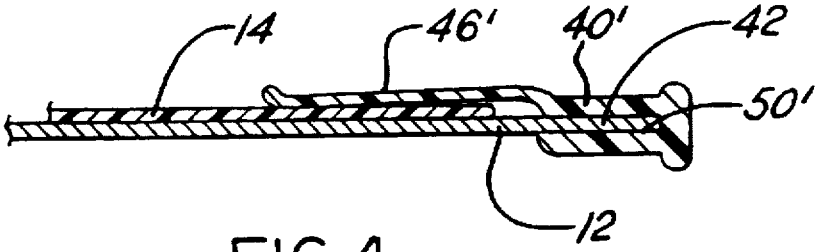
FIG. 4 is an alternate embodiment of an edge member for use with the present invention.

An alternate holder member 40' is shown in FIG. 4. Holder members 40 and 40' have channels 50 and 50', respectively, which tightly fit on the edge 42 of the rigid sign 12. With the holder member 40', it may not be necessary to attach it to the edge of the sign with rivets or other fasteners, so long as channel 50' is dimensioned to securely grip the edge of the sign.

Holder member 40' also has a front member 46' which, due to its design, applies a tension or force against the message overlay member 14. This helps hold the edges of the message overlay member in place on the sign.

The overlay member 14 is preferably a thin sheet of clear plastic material, such as polycarbonate. Preferably, the overlay member 14 is approximately 0.020" in thickness. Of course, thinner or thicker overlay members could be utilized, depending on the application and use.

The overlay member 14 has a size and shape slightly less than the dimensions of the sign 12. The overlay member 14 fits flush on the front surface 32 of the rigid sign 12 with its edges secured in the holder members 40, 40'. The overlay member 14 is preferably made of a clear or transparent material so that the reflective material on the front surface 32 of the sign 12 will be visible and can reflect light from passing vehicles.

The present invention also reduces the cost of reflective-type signs since only one reflective surface 32 is required for a wide variety of different messages and display indicia. On the other hand, it is possible to provide reflective surfaces on each of the overlay members 14, along with a message or display indicia, although this would increase the requisite cost.

The plastic overlay material also protects the reflective material on the front of the sign and prevents it from being marred, scraped or damaged. (The reflective material is typically very expensive.) This significantly increases the life of the rigid sign and reduces the cost of the signs over time. Also, if the protective layer becomes damaged or the warning legend on it becomes unreadable, the protective layer can be quickly and easily replaced—and at much less cost than replacement of the entire sign.

The actual display indicia 16 on the overlay member 14 is preferably printed or applied to the surface of the member 14 which is to be positioned against the front surface 32 of the rigid sign when the member 14 is placed on the sign. This protects the message and sign indicia from being damaged during use or by inclement weather conditions. The message 16 can be applied to the overlay member in any conventional manner, such as screen printing or decals. Also, as shown in FIG. 5, since the display message 16 is to be applied to the rear surface of the overlay member 14, that is, the side of the overlay member which is positioned against the front surface of the rigid sign 12, the message is applied in a reverse or mirror image manner.

Standard specifications for traffic control signs require a dark border 60 having a width of approximately ⅞–1¼ inches adjacent the edge of the sign. The specifications also require the border to be positioned slightly inside the outer edge of the sign material, on the order of ⅝–¾ of an inch. In order to display the border 60, it is preferably printed on or applied to the overlay member 14. It is also possible,. of course, to provide the border 60 on the front face 32 of the rigid sign 12. As an alternative, the holder members 40, 40' could include part of the border in or on their front members 46, 46'.

In order to install or remove the overlay member 14 from the sign 12, two or more adjacent edges of member 14 are first positioned in two adjacent holder members on the rigid sign 12. Then, the remaining two edges of member 14 are "worked" into the remaining holder members 40. This is shown in FIG. 3. In this regard, it is preferable to "bubble" the overlay material 14 in one corner, in order to position its remaining two edges in the holder members 40. Again, this is shown in FIG. 3. Removal of the member 14 from the sign 12 can be accomplished in the same manner.

It is also possible to provide a non-reflective material on the front surface or face 32 of the rigid sign 12. This is a lower cost alternative and depends on the particular application in which the sign is to be used.

As indicated, the plastic material forming the overlay member 14 protects the front surface 32 on the sign 12. This increases the useful life of any reflective material or indicia positioned on the sign.

Figure 7:
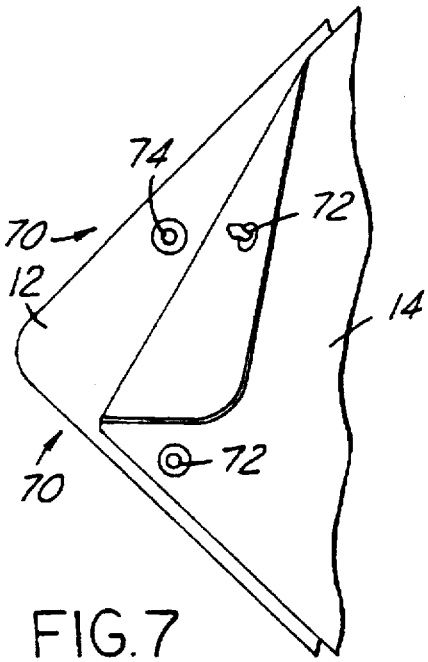

It is possible to use various other devices or mechanisms to hold the overlay member 14 in position on the front of the sign 12. For example, as shown in FIG. 7, snap connector mechanisms 70 can be used. One part 72 of the snap connector mechanism 70 is secured to the overlay members 14 and the other mating part 74 is secured to the sign 12. The snap parts 72, 74 are preferably positioned adjacent the edges of the sign and overlay member with several connector mechanisms 70 along each edge.

Figure 8:
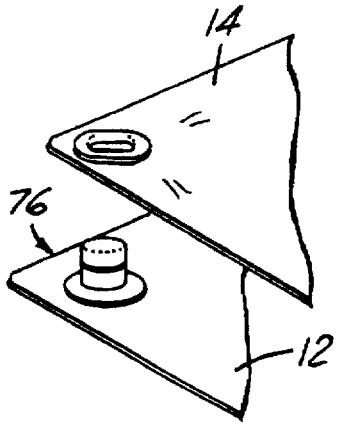
Figure 9:
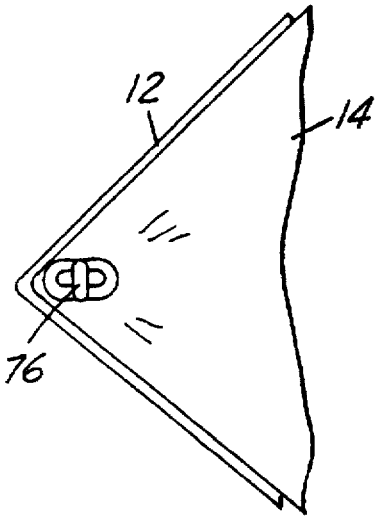

Similarly, other two-piece connector mechanisms could be used to secure the overlay member 14 to the sign 12, such as twist-lock fasteners 76 or VELCRO® type (hook and loop) fasteners 78. These are shown in FIGS. 8–10. Other systems, such as the recloseable fastening system marketed by 3M Co., could also be utilized. With each of these connector mechanisms, one part should be attached to the sign and the other mating part should be attached to the overlay member.

Other mechanisms which could be used include stretchable strap members 80 which are secured along the edges or corners of the overlay member 14. See FIGS. 11 and 12. The members 80 are stretched over the outer corners of the sign 12 and secured as by snaps, twist lock or other conventional fastener means 82 to the rear surfaces 84 of the signs. Stretch members 81 could also be clipped along the edges of the sign 12 by hook members 86, as shown in FIG. 13.

It is also possible to include biased frame members 90 along one or more of the edges of the sign 12. As shown in FIG. 14, the frame members 90 include a base member 92 secured to the sign 12, a cover member 94 rotatably secured to the base member, and a spring or biasing member 96. The overlay member 14 is held in position by the biased cover member 94. Frame mechanisms of this type are shown, for example, in U.S. Pat. Nos. 3,310,901 and 4,145,828.

As is evident from the above, there are a wide variety of devices and mechanisms which can be used to hold or secure the overlay member 14 to the sign 12. Additional mechanisms include zippers, screws, bolts, hooks, latches and other conventional fasteners.

FIGS. 15, 16A and 16B illustrate a preferred embodiment of the invention. The rigid sign 100 has a plurality of edge members 102, 103, 104 and 105 positioned around its outer perimeter. As shown, the edge members cover the entire perimeter of the sign edges, including the corners. In this manner, the corners are protected from abuse during use thereby lengthening the life of the rigid sign. (Typically, the corners of a rigid sign suffer the most abuse during use and this is one of the principal reasons for retirement of the sign.)

Edge members 102 and 104 are longer than edge members 103 and 105 and include rounded corner members 108, 110 at their ends. Since members 102 and 104 are mirror images of each other, only one member needs to be produced, but in duplicate. Edge members 102 and 104 are secured to the rigid sign by appropriate fastening means, such as pop rivets 112.

All four edge members 102, 103, 104 and 105 preferably are extruded plastic members provided in the cross-sectional size and shape shown in FIGS. 16A and 16B. Preferably the edge members are made from an extruded polycarbonate material.

A typical or representative edge member 103 is shown in FIGS. 16A and 16B. The member 103 has an upper flat member 120, a lower attachment member 122 and a channel 124. The member 103 fits over the edge of rigid sign 100 and is held in place by locking tabs or tangs 130. The tabs 130 are provided around all of the edges of the sign and releasably mate with locking channels 132 in the edge members.

When the edge members 102–105 are positioned on the sign 100, the members are positioned around the edges of the sign (as shown in FIG. 15) and locked onto the sign (as shown in FIG. 16A). For release of one of the edge members, for example to replace the plastic overlay member 140, a tool or instrument, such as a screwdriver 142, is used in the manner shown in FIG. 16B and one of the edge members is removed (this is shown in phantom 103' in FIG. 15).

As additional embodiments and features of the invention,. it is also possible to provide solid, dark replacement members for the rigid signs where required by road conditions, the status of the construction at the site, or as required by specifications. These "blocker" overlay members can be substituted for the normal message overlays by removal of one of the edge members and insertion of the edges of the overlay into the channels 124 in the edge member. This also prevents the construction crews from having to tip over unnecessary signs or to cover them with a tarp or the like.

It is also possible to provide storage pockets or the like (not shown) on the back of the rigid sign for storage of a blocker overlay or other overlays when they are not needed.

Although particular embodiments of the present invention have been illustrated in the accompanying drawings and described in the foregoing detailed description, it is to be understood that the present invention is not to be limited to just the embodiments disclosed, but that they are capable of numerous rearrangements, modifications and substitutions without departing from the scope of the claims hereafter.

What is claimed is:

1. A sign member for a sign stand to display messages to the passing public, said sign member comprising:

a rigid sign panel having a front planar surface with a plurality of edges and a plurality of corners, said planar surface having a light reflective material covering substantially the entire surface thereof;

a transparent planar overlay member positioned on said planar surface of said sign panel and sized to cover substantially said entire planar surface, said overlay member having a reverse image message on the surface of said overlay member which is positioned immediate adjacent said planar surface; and a plurality of elongated edge members, one of said edge members being positioned on each of said edges of said sign panel, said edge members securing said overlay member on said planar surface and also being positioned to protect said corners of said sign panel from damage;

at least one of said edge members comprising a one-piece resilient member which is separably removable from said sign panel, said resilient edge member being releasably secured to said sign panel by at least one tab-and-slot fastener mechanism;

wherein said overlay member can be replaced with another overlay member by removal of at least said resilient edge member in order to change the message to the passing public.

2. The sign member as set forth in claim 1 wherein each of said edge members comprise one-piece resilient members and each are releasably secured on said sign panel.

3. The sign member as set forth in claim 1 wherein at least one other of said edge members is fixedly secured to said sign panel.

4. The sign member as set forth in claim 1 wherein said sign stand includes a base member, a plurality of legs, an upright member for holding said sign member, and spring means connecting said upright member to said base member and allowing deflection of said sign member relative to said base member.

5. The sign member as set forth in claim 1 wherein each of said edge members comprise one-piece U-shaped members, each having a channel for holding an edge of said sign panel.

6. The sign member as set forth in claim 1 wherein said tab and slot fastener mechanism comprises a tab member on said sign panel and a mating slot member on said resilient removable edge member.

7. The sign member as set forth in claim 2 wherein each of said edge members are releasably secured on said sign panel by at least one tab-and-slot fastener mechanism.

* * * * *

UNITED STATES PATENT AND TRADEMARK OFFICE

CERTIFICATE OF CORRECTION

PATENT NO. : 5,675,923
DATED : October 14, 1997
INVENTOR(S) : John Sarkisian

It is certified that error appears in the above-identified patent and that said Letters Patent is hereby corrected as shown below:

Col. 4, line 67 "is also possible,." should read --is also possible,--

Col. 6, line 34 "invention,." should be --invention,--

Signed and Sealed this

Seventeenth Day of August, 1999

*Attest:*

*Attesting Officer*

Q. TODD DICKINSON

*Acting Commissioner of Patents and Trademarks*